US009501990B2

(12) United States Patent
Xiao

(10) Patent No.: US 9,501,990 B2
(45) Date of Patent: Nov. 22, 2016

(54) SCAN DRIVING CIRCUIT

(71) Applicant: SHENZHEN CHINA STAR OPTOELECTRONICS TECHNOLOGY CO., LTD., Shenzhen, Guangdong (CN)

(72) Inventor: Juncheng Xiao, Guangdong (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 113 days.

(21) Appl. No.: 14/416,558

(22) PCT Filed: Dec. 29, 2014

(86) PCT No.: PCT/CN2014/095318
§ 371 (c)(1),
(2) Date: Jan. 22, 2015

(87) PCT Pub. No.: WO2016/095262
PCT Pub. Date: Jun. 23, 2016

(65) Prior Publication Data

US 2016/0180788 A1 Jun. 23, 2016

(30) Foreign Application Priority Data

Dec. 19, 2014 (CN) ..... 2014 1 0795862

(51) Int. Cl.
*G09G 5/00* (2006.01)
*G09G 3/36* (2006.01)

(52) U.S. Cl.
CPC .... *G09G 3/3677* (2013.01); *G09G 2310/0202* (2013.01); *G09G 2310/0213* (2013.01); *G09G 2310/08* (2013.01); *G09G 2330/00* (2013.01)

(58) Field of Classification Search
CPC .... G09G 3/36; G09G 3/3648; G09G 3/3677; G09G 2310/0202; G09G 2310/0213
USPC ..... 345/87–100, 204–215
See application file for complete search history.

(56) References Cited

U.S. PATENT DOCUMENTS

2016/0126947 A1* 5/2016 Xiao ..... G09G 3/3648 327/109
2016/0126948 A1* 5/2016 Xiao ..... H03K 17/6871 327/109

* cited by examiner

*Primary Examiner* — Vijay Shankar
(74) *Attorney, Agent, or Firm* — Kirton McConkie; Evan R. Witt

(57) ABSTRACT

A scan driving circuit is disclosed and used to execute a driving operation for cascaded scan lines. The scan driving circuit has a pull-down control module, a pull-down module, a pull-up module, a pull-up maintaining module, a bootstrap capacitor, a constant low-level voltage source and a constant high-level voltage source; the scan driving circuit uses a PMOS type transistor to control the pull-down control module, the pull-down module, the pull-up module and the pull-up maintaining module. The scan driving circuit has a simple overall structure and lower energy consumption.

20 Claims, 4 Drawing Sheets

SCAN DRIVING CIRCUIT

FIELD OF THE INVENTION

The present invention relates to a field of display driving, and more particularly to a scan driving circuit.

BACKGROUND OF THE INVENTION

A gate driver on array (GOA) generates a scan driver circuit on an existing array substrate of a thin film transistor liquid crystal display (TFT-LCD) in order to implement a driving method which progressively scans for scan lines. A structural diagram of an existing scan driving circuit is illustrated in FIG. 1, and the scan driving circuit 10 includes a pull-up control module 101, a pull-up module 102, a down-stream module 103, a pull-down module 104, a bootstrap capacitor 105, and a pull-down maintaining module 106.

The scan driving circuit generally uses an N-Metal-Oxide-Semiconductor (NMOS) type transistor. However, for the production of the NMOS transistor, the production cost of a photomask which is used in a photolithography process is higher. Moreover, the overall circuit structure of the scan driving circuit is more complex so as to consume more energy.

As a result, it is necessary to provide a scan driving circuit to solve the problem existing in the conventional technologies.

SUMMARY OF THE INVENTION

A primary object of the present invention is to provide a scan driving circuit that has a simple structure and lower energy consumption, so as to solve the problem of an existing scan driving circuit which has a complex structure and higher energy consumption.

To solve the above problems, the technical solution of the present invention is as follows:

A scan driving circuit is provided in an embodiment of the present invention, the scan driving circuit is used to execute a driving operation for cascaded scan lines, and comprises:

a pull-down control module receiving a previous-level scan signal, and generating a low-level scan level signal corresponding to one of the scan lines according to the previous-level scan signal;

a pull-down module pulling down a scan signal of the corresponding scan line according to the scan level signal and a first clock signal;

a pull-up module pulling up the scan signal of the corresponding scan line according to a low-level signal and a high-level signal;

a pull-up maintaining module keeping the scan level signal of the corresponding scan line in a high-level according to the low-level signal and the high-level signal;

a bootstrap capacitor generating a low-level or a high-level of the scan level signal of the scan line;

a constant low-level voltage source providing the low-level signal; and a constant high-level voltage source providing the high-level signal;

wherein the scan driving circuit uses a P-metal-oxide-semiconductor (PMOS) type transistor to control the pull-down control module, the pull-down module, the pull-up module and the pull-up maintaining module;

wherein the pull-down control module includes a first switch transistor, a control end of the first switch transistor inputs the previous-level scan signal, an input end of the first switch transistor inputs a low-level scan signal, and an output end of the first switch transistor is connected to the pull-down module, the pull-up maintaining module and the bootstrap capacitor respectively;

wherein the pull-up maintaining module includes a second electrical potential maintaining capacitor, one end of the second electrical potential maintaining capacitor is connected to the constant high-level voltage source, and the other end of the second electrical potential maintaining capacitor is connected to the output end of the first switch transistor.

In the scan driving circuit of the present invention, the pull-down module comprises a second switch transistor, a control end of the second switch transistor is connected to the output end of the first switch transistor of the pull-down control module, an input end of the second switch transistor inputs a first clock signal, and an output end of the second switch transistor inputs a present-level scan signal.

In the scan driving circuit of the present invention, the pull-up module comprises a third switch transistor, a control end of the third switch transistor is connected to the constant low-level voltage source, an input end of the third switch transistor is connected to the constant high-level voltage source, and an output end of the third switch transistor is connected to the output end of the second switch transistor.

In the scan driving circuit of the present invention, the pull-up maintaining module further comprises a fourth switch transistor, a fifth switch transistor, a sixth switch transistor and a seventh switch transistor;

wherein a control end of the fourth switch transistor is connected to the input end of the second switch transistor, an input end of the fourth switch transistor is connected to an output end of the fifth switch transistor, and an output end of the fourth switch transistor is connected to the output end of the first switch transistor;

wherein a control end of the fifth switch transistor is connected to an output end of the seventh switch transistor, and an input end of the fifth switch transistor is connected to the constant high-level voltage source;

wherein a control end of the sixth switch transistor is connected to the output end of the first switch transistor, an input end of the sixth switch transistor is connected to the constant high-level voltage source, and an output end of the sixth switch transistor is connected to an output end of the seventh switch transistor;

wherein a control end of the seventh switch transistor inputs a second clock signal, an input end of the seventh switch transistor is connected to the constant low-level voltage source, and the output end of the seventh switch transistor is connected to the control end of the third switch transistor.

In the scan driving circuit of the present invention, the second clock signal and the first clock signal are reverse clock impulse signals.

In the scan driving circuit of the present invention, the pull-down control module further comprises a eighth switch transistor, a control end of the eighth switch transistor inputs a next-level scan signal, an input end of the eighth switch transistor inputs a low-level scan signal, and an output end of the eighth switch transistor is connected to the pull-down module, the pull-up maintaining module and the bootstrap capacitor respectively.

In the scan driving circuit of the present invention, the pull-up maintaining module further comprises a first electrical potential maintaining capacitor, one end of the first electrical potential maintaining capacitor is connected to the constant high-level voltage source, and the other end of the first electrical potential maintaining capacitor is connected to the output end of the seventh switch transistor.

In the scan driving circuit of the present invention, the pull-down control module comprises a first switch transistor and a ninth switch transistor;

wherein the control end of the first switch transistor inputs a low-level scan signal, the input end of the first switch transistor inputs the previous-level scan signal, and the output end of the first switch transistor is connected to an input end of the ninth switch transistor;

wherein a control end of the ninth switch transistor inputs a second clock signal, and an output end of the ninth switch transistor is connected to the pull-down module, the pull-up maintaining module and the bootstrap capacitor respectively.

In the scan driving circuit of the present invention, the second clock signal and the first clock signal are reverse clock impulse signals.

In the scan driving circuit of the present invention, the pull-down control module further comprises an eighth switch transistor;

wherein a control end of the eighth switch transistor inputs a low-level scan signal, an input end of the eighth switch transistor inputs a next-level scan signal, and an output end of the eighth switch transistor is connected to an input end of the ninth switch transistor.

A scan driving circuit is provided in an embodiment of the present invention, the scan driving circuit is used to execute a driving operation for cascaded scan lines, and comprises:

a pull-down control module receiving a previous-level scan signal, and generating a low-level scan level signal corresponding to one of the scan lines according to the previous-level scan signal;

a pull-down module pulling down a scan signal of the corresponding scan line according to the scan level signal and a first clock signal;

a pull-up module pulling up the scan signal of the corresponding scan line according to a low-level signal and a high-level signal;

a pull-up maintaining module keeping the scan level signal of the corresponding scan line in a high-level according to the low-level signal and the high-level signal;

a bootstrap capacitor generating a low-level or a high-level of the scan level signal of the scan line;

a constant low-level voltage source providing the low-level signal; and a constant high-level voltage source providing the high-level signal;

wherein the scan driving circuit uses a P-metal-oxide-semiconductor (PMOS) type transistor to control the pull-down control module, the pull-down module, the pull-up module and the pull-up maintaining module.

In the scan driving circuit of the present invention, the pull-down control module includes a first switch transistor, a control end of the first switch transistor inputs the previous-level scan signal, an input end of the first switch transistor inputs a low-level scan signal, and an output end of the first switch transistor is connected to the pull-down module, the pull-up maintaining module and the bootstrap capacitor respectively.

In the scan driving circuit of the present invention, the pull-down module comprises a second switch transistor, a control end of the second switch transistor is connected to the output end of the first switch transistor of the pull-down control module, an input end of the second switch transistor inputs a first clock signal, and an output end of the second switch transistor inputs a present-level scan signal.

In the scan driving circuit of the present invention, the pull-up module comprises a third switch transistor, a control end of the third switch transistor is connected to the constant low-level voltage source, an input end of the third switch transistor is connected to the constant high-level voltage source, and an output end of the third switch transistor is connected to the output end of the second switch transistor.

In the scan driving circuit of the present invention, the pull-up maintaining module further comprises a fourth switch transistor, a fifth switch transistor, a sixth switch transistor and a seventh switch transistor;

wherein a control end of the fourth switch transistor is connected to the input end of the second switch transistor, an input end of the fourth switch transistor is connected to an output end of the fifth switch transistor, and an output end of the fourth switch transistor is connected to the output end of the first switch transistor;

wherein a control end of the fifth switch transistor is connected to an output end of the seventh switch transistor, and an input end of the fifth switch transistor is connected to the constant high-level voltage source;

wherein a control end of the sixth switch transistor is connected to the output end of the first switch transistor, an input end of the sixth switch transistor is connected to the constant high-level voltage source, and an output end of the sixth switch transistor is connected to an output end of the seventh switch transistor;

wherein a control end of the seventh switch transistor inputs a second clock signal, an input end of the seventh switch transistor is connected to the constant low-level voltage source, and the output end of the seventh switch transistor is connected to the control end of the third switch transistor;

wherein the second clock signal and the first clock signal are reverse clock impulse signals.

In the scan driving circuit of the present invention, the pull-down control module further comprises an eighth switch transistor, a control end of the eighth switch transistor inputs a next-level scan signal, an input end of the eighth switch transistor inputs a low-level scan signal, and an output end of the eighth switch transistor is connected to the pull-down module, the pull-up maintaining module and the bootstrap capacitor respectively.

In the scan driving circuit of the present invention, the pull-up maintaining module further comprises a first electrical potential maintaining capacitor, one end of the first electrical potential maintaining capacitor is connected to the constant high-level voltage source, and the other end of the first electrical potential maintaining capacitor is connected to the output end of the seventh switch transistor.

In the scan driving circuit of the present invention, the pull-up maintaining module includes a second electrical potential maintaining capacitor, one end of the second electrical potential maintaining capacitor is connected to the constant high-level voltage source, and the other end of the second electrical potential maintaining capacitor is connected to the output end of the first switch transistor.

In the scan driving circuit of the present invention, the pull-down control module comprises a first switch transistor and a ninth switch transistor;

wherein the control end of the first switch transistor inputs a low-level scan signal, the input end of the first switch transistor inputs the previous-level scan signal, and the output end of the first switch transistor is connected to an input end of the ninth switch transistor;

wherein a control end of the ninth switch transistor inputs a second clock signal, and an output end of the ninth switch transistor is connected to the pull-down module, the pull-up maintaining module and the bootstrap capacitor respectively;

wherein the second clock signal and the first clock signal are reverse clock impulse signals.

In the scan driving circuit of the present invention, the pull-down control module further comprises an eighth switch transistor;

wherein a control end of the eighth switch transistor inputs a low-level scan signal, an input end of the eighth switch transistor inputs a next-level scan signal, and an output end of the eighth switch transistor is connected to the input end of the ninth switch transistor.

In contrast to the existing scan driving circuit, the scan driving circuit of the present invention uses a PMOS type transistor to control every module, so as to let the scan driving circuit to have a simple overall structure and lower energy consumption, which solves the problem of the existing scan driving circuit having a complex structure and higher energy consumption.

To allow the above description of the present invention to be more clear and comprehensive, there are preferred embodiments with the accompanying figures described in detail below.

DETAILED DESCRIPTION OF THE PREFERRED EMBODIMENTS

Figure 1:
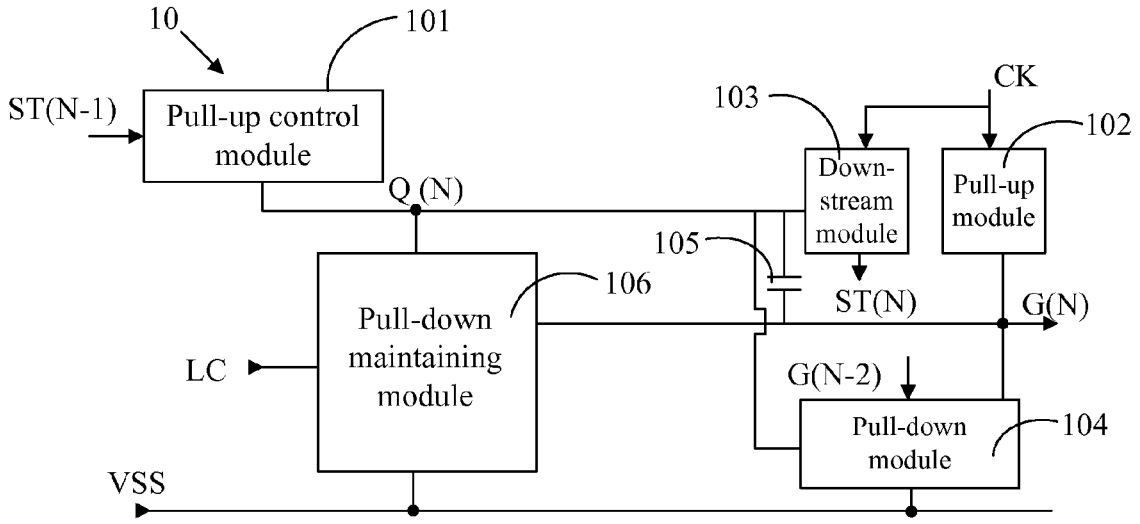
Fig.1 Prior Art
FIG. 1 is a structural diagram of an existing scan driving circuit.

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side, longitudinal/vertical, transverse/horizontal, etc., are only directions by referring to the accompanying drawings, and thus the used directional terms are used to describe and understand the present invention, but the present invention is not limited thereto.

In the drawings, units with similar structures are represented with the same label.

Figure 2:
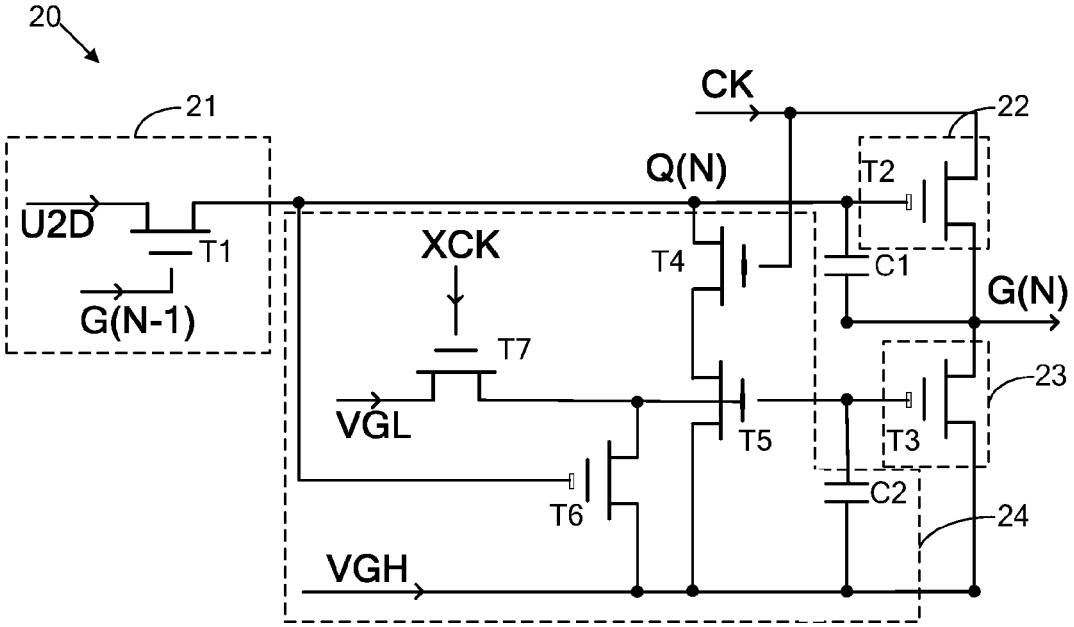
FIG. 2 is a structural diagram of a scan driving circuit according to the first preferred embodiment of the present invention.

Refer to FIG. 2, which is a structural diagram of a scan driving circuit according to the first preferred embodiment of the present invention. The scan driving circuit 20 of the present preferred embodiment is used to execute a driving operation for cascaded scan lings, and comprises: a pull-down control module 21, a pull-down module 22, a pull-up module 23, a pull-up maintaining module 24, a bootstrap capacitor C1, a constant low-level voltage source and constant high-level voltage source. The pull-down control module 21 is used to receive a previous-level scan signal G(N−1) and generate a low-level scan level signal Q(N) corresponding to one of the scan lines according to the previous-level scan signal G(N−1); the pull-down module 22 is used to pull down a scan signal G(N) of the corresponding scan line according to the scan level signal Q(N) and a first clock signal CK; the pull-up module 23 is used to pull up the scan signal G(N) of the corresponding scan line according to a low-level signal VGL and a high-level signal VGH; the pull-up maintaining module 24 is used to keep the scan level signal Q(N) of the corresponding scan line in a high-level according to the low-level signal VGL and the high-level signal VGH; the bootstrap capacitor C1 is used to generate a low-level or a high-level of the scan level signal Q(N) of the scan line; the constant low-level voltage source is used to provide the low-level signal VGL; and the constant high-level voltage source is used to provide the high-level signal VGH.

The scan driving circuit 20 of the present invention uses a P-metal-oxide-semiconductor (PMOS) type transistor to control the pull-down control module 21, the pull-down module 22, the pull-up module 23 and the pull-up maintaining module 24.

The pull-down control module 21 includes a first switch transistor T1. A control end of the first switch transistor T1 inputs the previous-level scan signal G(N−1), an input end of the first switch transistor T1 inputs a low-level scan signal U2D, and an output end of the first switch transistor T1 is connected to the pull-down module 22, the pull-up maintaining module 23 and the bootstrap capacitor C1 respectively.

The pull-down module 22 comprises a second switch transistor T2. A control end of the second switch transistor T2 is connected to the output end of the first switch transistor T1 of the pull-down control module 21, an input end of the second switch transistor T2 inputs a first clock signal CK, and an output end of the second switch transistor T2 inputs a present-level scan signal G(N).

The pull-up module 23 comprises a third switch transistor T3. A control end of the third switch transistor T3 is connected to the constant low-level voltage source, an input end of the third switch transistor T3 is connected to the constant high-level voltage source, and an output end of the third switch transistor T3 is connected to the output end of the second switch transistor T2.

The pull-up maintaining module 24 further comprises a fourth switch transistor T4, a fifth switch transistor T5, a sixth switch transistor T6, a seventh switch transistor T7 and a first electrical potential maintaining capacitor C2.

A control end of the fourth switch transistor T4 is connected to the input end of the second switch transistor T2, an input end of the fourth switch transistor T4 is connected to an output end of the fifth switch transistor T5, and an output end of the fourth switch transistor T4 is connected to the output end of the first switch transistor T1.

A control end of the fifth switch transistor T5 is connected to an output end of the seventh switch transistor T7, and an input end of the fifth switch transistor T5 is connected to the constant high-level voltage source.

A control end of the sixth switch transistor T6 is connected to the output end of the first switch transistor T1, an input end of the sixth switch transistor T6 is connected to the constant high-level voltage source, and an output end of the sixth switch transistor T6 is connected to an output end of the seventh switch transistor T7.

A control end of the seventh switch transistor T7 inputs a second clock signal XCK, an input end of the seventh switch transistor T7 is connected to the constant low-level voltage source, and the output end of the seventh switch transistor T7 is connected to the control end of the third switch transistor T3.

One end of the first electrical potential maintaining capacitor C2 is connected to the constant high-level voltage source, and the other end of the first electrical potential maintaining capacitor C2 is connected to the output end of the seventh switch transistor T7.

The first clock signal CK and the second clock signal XCK are reverse clock impulse signals.

The bootstrap capacitor C1 is set up between the output end of the first switch transistor T1 and the output end of the second switch transistor T2 of the pull-down module 22.

Figure 3:
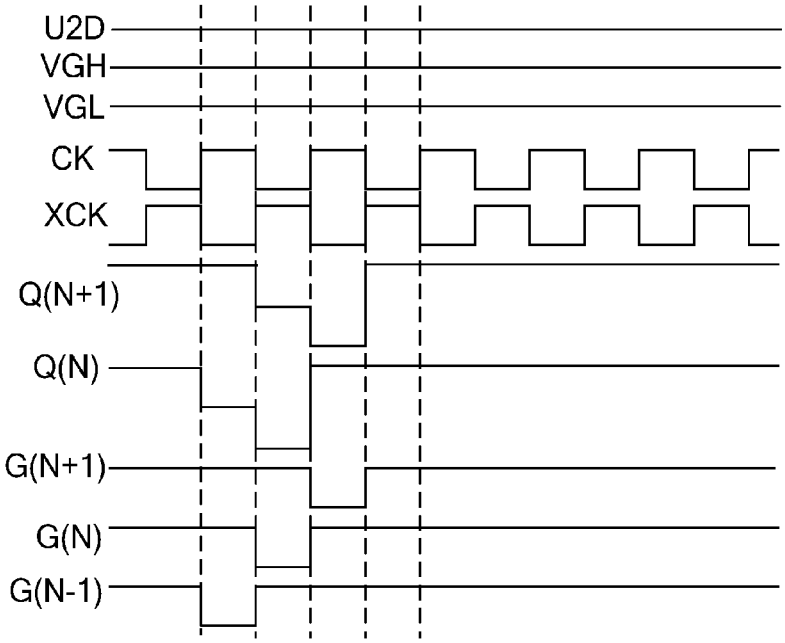
FIG. 3 is a signal waveform diagram of a scan driving circuit according to the first preferred embodiment of the present invention.

Referring to FIG. 2 and FIG. 3, FIG. 3 is a signal waveform diagram of a scan driving circuit according to the first preferred embodiment of the present invention. All the switch transistors of the present preferred embodiment are PMOS type transistors. When the scan driving circuit 20 of the present preferred embodiment is operated and the previous-level scan signal G(N−1) is turned into a low-level signal, the first clock signal CK is a high-level signal, the second clock signal XCK is a low-level signal, the first switch transistor T1 is turned on, and the low-level scan signal U2D outputs to the control end of the second switch transistor T2 through the first switch transistor T1, so as to pull down the scan level signal Q(N) of the scan line. Therefore, the second switch transistor T2 is turned on. However, due to the first clock signal CK being a high-level signal, the scan signal G(N) is still a high-level signal. At the same time, the sixth switch transistor T6 is turned on, the third switch transistor T3 and the fifth switch transistor T5 are turned off through a high-level signal VGH, and the fourth switch transistor T4 is turned off through the first clock signal CK.

Afterwards, the previous-level scan signal G(N−1) is turned into a high-level signal, the first clock signal CK is turned into a low-level signal, the second clock signal XCK is turned into a high-level signal, the first switch transistor T1 is turned off, and the second switch transistor T2 is still turned on under the effect of the bootstrap capacitor C1, so as to the scan signal G(N) is turned into a low-level signal under the effect of the first clock signal CK through the second switch transistor T2. The electrical potential of the scan level signal Q(N) of the scan line is pulled down under the effect of the scan signal G(N) and the bootstrap capacitor C1, so as to let the electrical potential of the scan level signal Q(N) to be lower. At this time, since the sixth switch transistor T6 is turned on, the third switch transistor T3 and the fifth switch transistor T5 are still turned off under the effect of the high-level signal VGH, and the fourth switch transistor T4 is turned on under the effect of the first clock signal CK.

Then, the first clock signal CK is turned into a high-level signal, and the second clock signal XCK is turned into a low-level signal; at this time, the seventh switch transistor T7 is turned on under the effect of the second clock signal, and the third switch transistor T3 and the fifth switch transistor T5 are turned on under the effect of the low-level signal VGL; and the scan signal G(N) is pulled up by the high-level signal HGL through the third switch transistor T3, and the scan level signal Q(N) of the scan line is pulled up through the bootstrap capacitor C1. The fourth switch transistor is turned off under the effect of the first clock signal CK, and the first switch transistor T1 is turned off under the effect of the previous-level scan signal G(N−1). Therefore, the scan level signal Q(N) of the scan line can be kept in a high-level, so as to keep the scan signal G(N) in a high-level.

Afterwards, the first clock signal is turned into a low-level signal, and the second clock signal is turned into a high-level signal; at this time, the fourth switch transistor T4 is turned on under the effect of the first clock signal CK, and the fifth switch transistor T5 is also turned on under the effect of the first electrical potential maintaining capacitor C2. The scan level signal Q(N) of the scan line can kept in a high-level by receiving the high-level signal VGH through the fourth switch transistor T4 and the fifth switch transistor T5, and the scan signal G(N) is also kept in a high-level.

The scan level signal Q(N) of the scan line and the scan signal G(N) are always kept in a high-level (through the third switch transistor T3 or the fourth switch transistor T4 and the fifth switch transistor T5). Until the first switch transistor is turned on, the scan level signal Q(N) of the scan line and the scan signal G(N) are turned into a low-level through the low-level scan signal U2D.

The driving operation for the cascaded scan lines of the scan driving circuit 20 of the present preferred embodiment is thus implemented.

The scan driving circuit of the present invention uses a PMOS type transistor to control every module, so as to let the scan driving circuit to have a simple overall structure and lower energy consumption.

Figure 4:
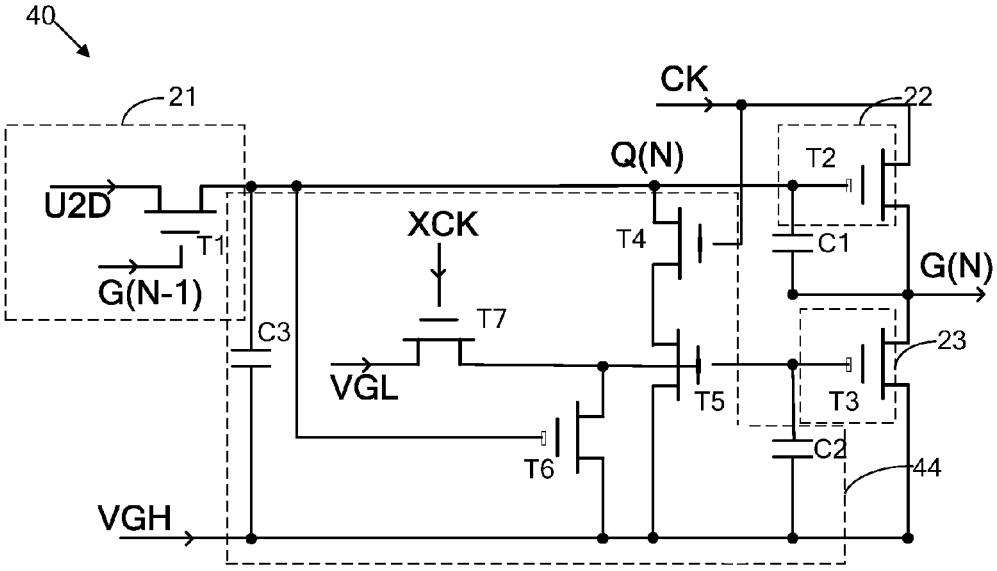
FIG. 4 is a structural diagram of a scan driving circuit according to the second preferred embodiment of the present invention.

Refer to FIG. 4, which is a structural diagram of a scan driving circuit according to the second preferred embodiment of the present invention. On the basis of the first preferred embodiment, the pull-up maintaining module 44 of the scan driving circuit 40 of the present preferred embodiment further comprises a second electrical potential maintaining capacitor C3. One end of the second electrical potential maintaining capacitor C3 is connected to the constant high-level voltage source, and the other end of the second electrical potential maintaining capacitor C3 is connected to the output end of the first switch transistor T1.

The configuration of the second electrical potential maintaining capacitor C3 avoids the electrical leakage phenomenon of the scan level signal Q(N) through other switch transistors. Therefore, the scan signal Q(N) can be kept in a high-level through the second electrical potential maintaining capacitor C3 and the high level signal HGL.

Figure 5:
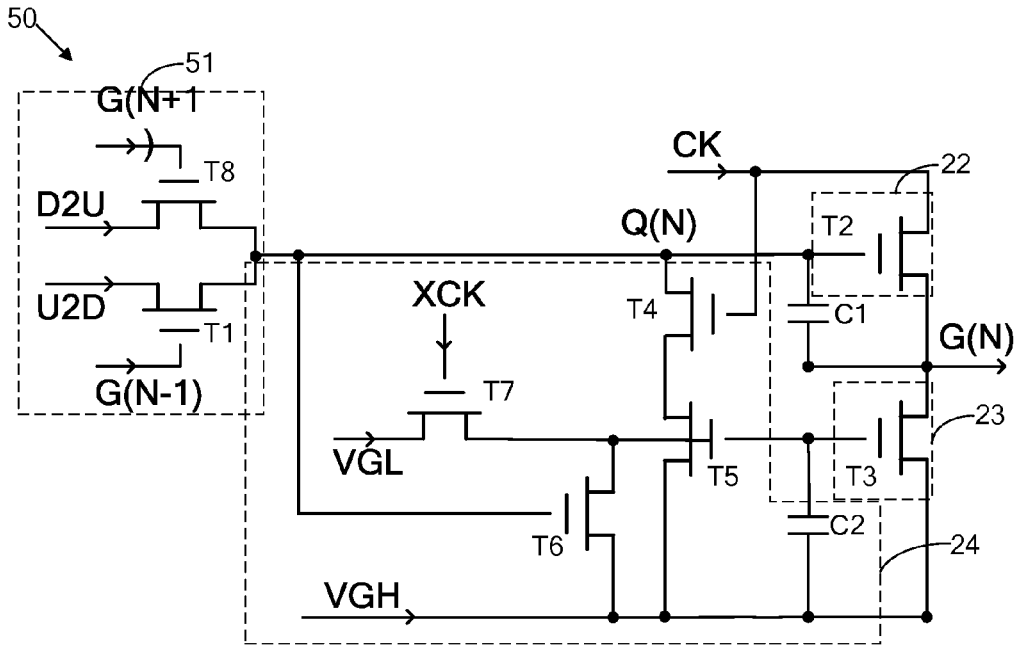
FIG. 5 is a structural diagram of a scan driving circuit according to the third preferred embodiment of the present invention.

Refer to FIG. 5, which is a structural diagram of a scan driving circuit according to the third preferred embodiment of the present invention. On the basis of the first preferred embodiment, the pull-down control module 51 of the scan driving circuit 50 further comprises an eighth switch transistor T8. A control end of the eighth switch transistor T8 inputs a next-level scan signal G(N+1), an input end of the eighth switch transistor T8 inputs a low-level scan signal D2U, and an output end of the eighth switch transistor T8 is connected to the pull-down module 22, the pull-up maintaining module 24 and the bootstrap capacitor C1 respectively.

The scan driving circuit 50 of the present preferred embodiment implements a reverse scanning operation through the eighth switch transistor T8, which pulls down a present-level scan signal G(N) though the next-level scan signal G(N+1).

Figure 6:
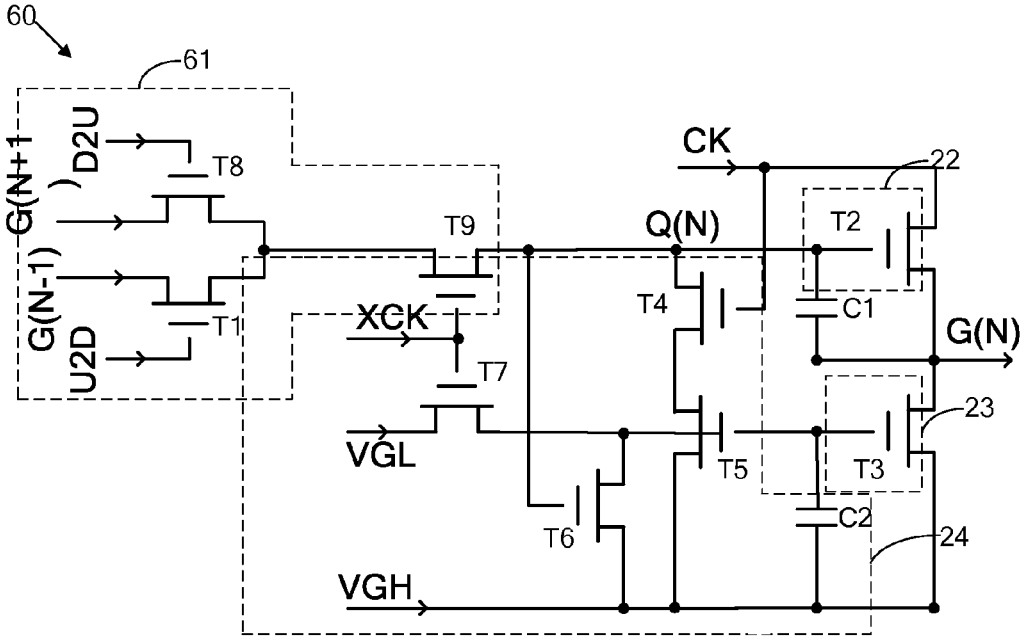
FIG. 6 is a structural diagram of a scan driving circuit according to the fourth preferred embodiment of the present invention.

Refer to FIG. 6, which is a structural diagram of a scan driving circuit according to the fourth preferred embodiment of the present invention. On the basis of the first preferred embodiment, the pull-down control module 61 of the scan driving circuit 60 of the present preferred embodiment comprises a first switch transistor T1, a ninth switch transistor T9 and the eighth switch transistor T8.

The control end of the first switch transistor T1 inputs a low-level scan signal U2D, the input end of the first switch transistor T1 inputs the previous-level scan signal G(N−1), and the output end of the first switch transistor T1 is connected to an input end of the ninth switch transistor T9. A control end of the ninth switch transistor T9 inputs a second clock signal XCK, and an output end of the ninth switch transistor T9 is connected to the pull-down module 22, the pull-up maintaining module 24 and the bootstrap capacitor C1 respectively. The second clock signal XCK and the first clock signal CK are reverse clock impulse signals. A control end of the eighth switch transistor T8 inputs a low-level scan signal D2U, an input end of the eighth switch transistor T8 inputs a next-level scan signal G(N+1), and an output end of the eighth switch transistor T8 is connected to an input end of the ninth switch transistor T9.

In the present preferred embodiment, the first switch transistor T1 and the ninth switch transistor T9 implement the operation of the first switch transistor T1 of the first preferred embodiment; and the eighth switch transistor T8 and the ninth switch transistor T9 implement the operation of the eighth switch transistor of the third preferred embodiment.

The specific working principles of the scan driving circuit of the present preferred embodiment are the same as or similar to the above first preferred embodiment and the third preferred embodiment. Please refer the specific details in the related descriptions of the first preferred embodiment and the third preferred embodiment.

The first switch transistor T1 and the eighth switch transistor T8 are always turned on, which ensures the stability of the output low-level signal of the pull-down control module.

The scan driving circuit of the present invention uses a PMOS type transistor to control every module, so as to let the scan driving circuit to have a simple overall structure and lower energy consumption, thus implementing a narrow border design of the corresponding liquid display device successfully. The present invention solves the problem of the existing scan driving circuit having a complex structure and higher energy consumption.

In summary, the present invention has been disclosed with preferred embodiments thereof, but the above described preferred embodiments are not intended to limit the present invention. Those who are skilled in the art can make many changes and modifications to the described embodiments which can be carried out without departing from the scope and the spirit of the invention that is intended to be limited only by the appended claims.

What is claimed is:

1. A scan driving circuit, executing a driving operation for cascaded scan lines, comprising:

a pull-down control module receiving a previous-level scan signal, and generating a low-level scan level signal corresponding to one of the scan lines according to the previous-level scan signal;

a pull-down module pulling down a scan signal of the corresponding scan line according to the scan level signal and a first clock signal;

a pull-up module pulling up the scan signal of the corresponding scan line according to a low-level signal and a high-level signal;

a pull-up maintaining module keeping the scan level signal of the corresponding scan line in a high-level according to the low-level signal and the high-level signal;

a bootstrap capacitor generating a low-level or a high-level of the scan level signal of the scan line;

a constant low-level voltage source providing the low-level signal; and a constant high-level voltage source providing the high-level signal;

wherein the scan driving circuit uses a P-metal-oxide-semiconductor (PMOS) type transistor to control the pull-down control module, the pull-down module, the pull-up module and the pull-up maintaining module;

wherein the pull-down control module includes a first switch transistor, a control end of the first switch transistor inputs the previous-level scan signal, an input end of the first switch transistor inputs a low-level scan signal, and an output end of the first switch transistor is connected to the pull-down module, the pull-up maintaining module and the bootstrap capacitor respectively;

wherein the pull-up maintaining module includes a second electrical potential maintaining capacitor, one end of the second electrical potential maintaining capacitor is connected to the constant high-level voltage source, and the other end of the second electrical potential maintaining capacitor is connected to the output end of the first switch transistor.

2. The scan driving circuit according to claim 1, wherein the pull-down module comprises a second switch transistor, a control end of the second switch transistor is connected to the output end of the first switch transistor of the pull-down control module, an input end of the second switch transistor inputs a first clock signal, and an output end of the second switch transistor inputs a present-level scan signal.

3. The scan driving circuit according to claim 2, wherein the pull-up module comprises a third switch transistor, a control end of the third switch transistor is connected to the constant low-level voltage source, an input end of the third switch transistor is connected to the constant high-level voltage source, and an output end of the third switch transistor is connected to the output end of the second switch transistor.

4. The scan driving circuit according to claim 3, wherein the pull-up maintaining module further comprises a fourth switch transistor, a fifth switch transistor, a sixth switch transistor and a seventh switch transistor;

wherein a control end of the fourth switch transistor is connected to the input end of the second switch transistor, an input end of the fourth switch transistor is connected to an output end of the fifth switch transistor, and an output end of the fourth switch transistor is connected to the output end of the first switch transistor;

wherein a control end of the fifth switch transistor is connected to an output end of the seventh switch transistor, and an input end of the fifth switch transistor is connected to the constant high-level voltage source;

wherein a control end of the sixth switch transistor is connected to the output end of the first switch transistor, an input end of the sixth switch transistor is connected to the constant high-level voltage source, and an output end of the sixth switch transistor is connected to an output end of the seventh switch transistor;

wherein a control end of the seventh switch transistor inputs a second clock signal, an input end of the seventh switch transistor is connected to the constant low-level voltage source, and the output end of the seventh switch transistor is connected to the control end of the third switch transistor.

5. The scan driving circuit according to claim 4, wherein the second clock signal and the first clock signal are reverse clock impulse signals.

6. The scan driving circuit according to claim 4, wherein the pull-down control module further comprises an eighth switch transistor, a control end of the eighth switch transistor inputs a next-level scan signal, an input end of the eighth switch transistor inputs a low-level scan signal, and an output end of the eighth switch transistor is connected to the pull-down module, the pull-up maintaining module and the bootstrap capacitor respectively.

7. The scan driving circuit according to claim 4, wherein the pull-up maintaining module further comprises a first electrical potential maintaining capacitor, one end of the first electrical potential maintaining capacitor is connected to the constant high-level voltage source, and the other end of the first electrical potential maintaining capacitor is connected to the output end of the seventh switch transistor.

8. The scan driving circuit according to claim 1, wherein the pull-down control module comprises a first switch transistor and a ninth switch transistor;

wherein the control end of the first switch transistor inputs a low-level scan signal, the input end of the first switch transistor inputs the previous-level scan signal, and the output end of the first switch transistor is connected to an input end of the ninth switch transistor;

wherein a control end of the ninth switch transistor inputs a second clock signal, and an output end of the ninth switch transistor is connected to the pull-down module, the pull-up maintaining module and the bootstrap capacitor respectively.

9. The scan driving circuit according to claim 1, wherein the second clock signal and the first clock signal are reverse clock impulse signals.

10. The scan driving circuit according to claim 1, wherein the pull-down control module further comprises an eighth switch transistor;

wherein a control end of the eighth switch transistor inputs a low-level scan signal, an input end of the eighth switch transistor inputs a next-level scan signal, and an output end of the eighth switch transistor is connected to an input end of the ninth switch transistor.

11. A scan driving circuit, executing a driving operation for cascaded scan lines, comprising:

a pull-down control module receiving a previous-level scan signal, and generating a low-level scan level signal corresponding to one of the scan lines according to the previous-level scan signal;

a pull-down module pulling down a scan signal of the corresponding scan line according to the scan level signal and a first clock signal;

a pull-up module pulling up the scan signal of the corresponding scan line according to a low-level signal and a high-level signal;

a pull-up maintaining module keeping the scan level signal of the corresponding scan line in a high-level according to the low-level signal and the high-level signal;

a bootstrap capacitor generating a low-level or a high-level of the scan level signal of the scan line;

a constant low-level voltage source providing the low-level signal; and a constant high-level voltage source providing the high-level signal;

wherein the scan driving circuit uses a P-metal-oxide-semiconductor (PMOS) type transistor to control the pull-down control module, the pull-down module, the pull-up module and the pull-up maintaining module.

12. The scan driving circuit according to claim 11, wherein the pull-down control module includes a first switch transistor, a control end of the first switch transistor inputs the previous-level scan signal, an input end of the first switch transistor inputs a low-level scan signal, and an output end of the first switch transistor is connected to the pull-down module, the pull-up maintaining module and the bootstrap capacitor respectively.

13. The scan driving circuit according to claim 12, wherein the pull-down module comprises a second switch transistor, a control end of the second switch transistor is connected to the output end of the first switch transistor of the pull-down control module, an input end of the second switch transistor inputs a first clock signal, and an output end of the second switch transistor inputs a present-level scan signal.

14. The scan driving circuit according to claim 13, wherein the pull-up module comprises a third switch transistor, a control end of the third switch transistor is connected to the constant low-level voltage source, an input end of the third switch transistor is connected to the constant high-level voltage source, and an output end of the third switch transistor is connected to the output end of the second switch transistor.

15. The scan driving circuit according to claim 14, wherein the pull-up maintaining module further comprises a fourth switch transistor, a fifth switch transistor, a sixth switch transistor and a seventh switch transistor;

wherein a control end of the fourth switch transistor is connected to the input end of the second switch transistor, an input end of the fourth switch transistor is connected to an output end of the fifth switch transistor, and an output end of the fourth switch transistor is connected to the output end of the first switch transistor;

wherein a control end of the fifth switch transistor is connected to an output end of the seventh switch transistor, and an input end of the fifth switch transistor is connected to the constant high-level voltage source;

wherein a control end of the sixth switch transistor is connected to the output end of the first switch transistor, an input end of the sixth switch transistor is connected to the constant high-level voltage source, and an output end of the sixth switch transistor is connected to an output end of the seventh switch transistor;

wherein a control end of the seventh switch transistor inputs a second clock signal, an input end of the seventh switch transistor is connected to the constant low-level voltage source, and the output end of the seventh switch transistor is connected to the control end of the third switch transistor;

wherein the second clock signal and the first clock signal are reverse clock impulse signals.

16. The scan driving circuit according to claim 15, wherein the pull-down control module further comprises an eighth switch transistor, a control end of the eighth switch transistor inputs a next-level scan signal, an input end of the eighth switch transistor inputs a low-level scan signal, and an output end of the eighth switch transistor is connected to the pull-down module, the pull-up maintaining module and the bootstrap capacitor respectively.

17. The scan driving circuit according to claim 15, wherein the pull-up maintaining module further comprises a first electrical potential maintaining capacitor, one end of the first electrical potential maintaining capacitor is connected to the constant high-level voltage source, and the other end of the first electrical potential maintaining capacitor is connected to the output end of the seventh switch transistor.

18. The scan driving circuit according to claim 17, wherein the pull-up maintaining module includes a second electrical potential maintaining capacitor, one end of the second electrical potential maintaining capacitor is connected to the constant high-level voltage source, and the other end of the second electrical potential maintaining capacitor is connected to the output end of the first switch transistor.

19. The scan driving circuit according to claim 11, wherein the pull-down control module comprises a first switch transistor and a ninth switch transistor;

wherein the control end of the first switch transistor inputs a low-level scan signal, the input end of the first switch transistor inputs the previous-level scan signal, and the output end of the first switch transistor is connected to an input end of the ninth switch transistor;

wherein a control end of the ninth switch transistor inputs a second clock signal, and an output end of the ninth switch transistor is connected to the pull-down module, the pull-up maintaining module and the bootstrap capacitor respectively;

wherein the second clock signal and the first clock signal are reverse clock impulse signals.

20. The scan driving circuit according to claim 19, wherein the pull-down control module further comprises an eighth switch transistor;

wherein a control end of the eighth switch transistor inputs a low-level scan signal, an input end of the eighth switch transistor inputs a next-level scan signal, and an output end of the eighth switch transistor is connected to the input end of the ninth switch transistor.

* * * * *